US005347797A

United States Patent [19]

Seal et al.

[11] Patent Number: 5,347,797

[45] Date of Patent: Sep. 20, 1994

[54] MOUNTING STIRRUP

[76] Inventors: Lesley T. Seal; Galen Seal, Jr., both of 2115 W. 14th St., Encinitas, Calif. 92024

[21] Appl. No.: 690,196

[22] Filed: Apr. 23, 1991

[51] Int. Cl.[5] ..... B68C 1/16

[52] U.S. Cl. ..... 54/46.1; 54/47

[58] Field of Search ..... 54/46, 47

[56] References Cited

U.S. PATENT DOCUMENTS

| | | | |
|---|---|---|---|
| 255,334 | 3/1882 | Reister | 54/46 X |
| 1,700,718 | 1/1929 | Roberts | 231/2.1 |
| 3,234,711 | 2/1966 | Jamieson | 54/46.1 |
| 4,601,161 | 7/1986 | Drellich | 54/46 X |
| 4,761,938 | 8/1988 | Townsend | 54/47 |
| 4,942,721 | 7/1990 | Van Scoyk | 54/46 |
| 5,216,874 | 6/1993 | Farrow | 54/46.1 |

*Primary Examiner*—Robert P. Swiatek

*Attorney, Agent, or Firm*—Harness, Dickey & Pierce

[57] ABSTRACT

A mounting stirrup on a strap with a loop that attaches to the horn of a Western Saddle or the stirrup bar of an English Saddle to assist the equestrian in mounting the horse. The mounting stirrup hangs below the regular stirrup and allows a short rider to use their right foot in the mounting stirrup to gain access to the regular stirrup with the left foot. This invention allows a youthful or short rider to safely and easily reach the regular stirrup of any conventional saddle and thereby mount without assistance.

4 Claims, 2 Drawing Sheets

FIG. 1
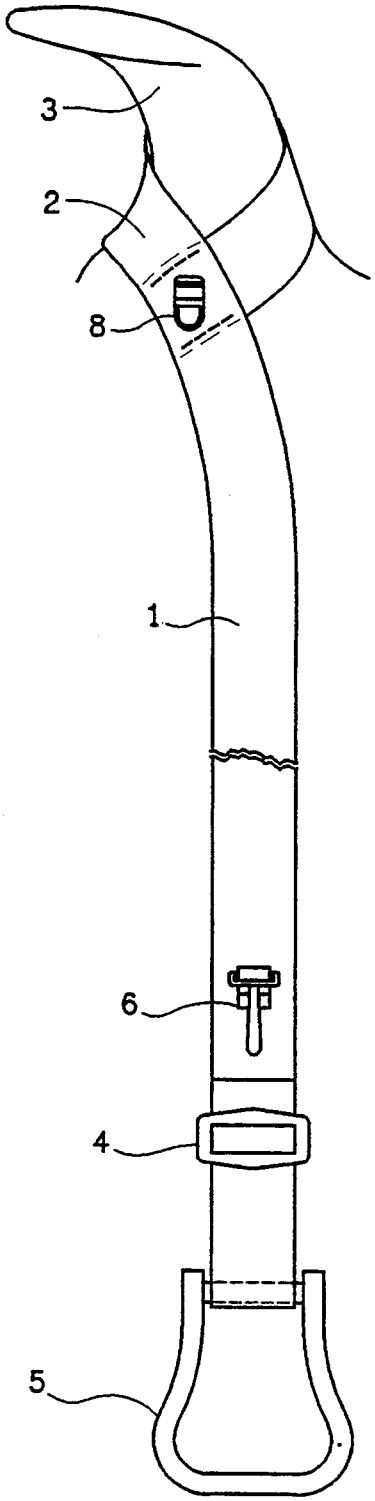
FIG. 4
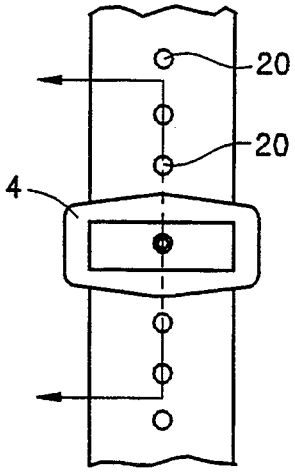
FIG. 2
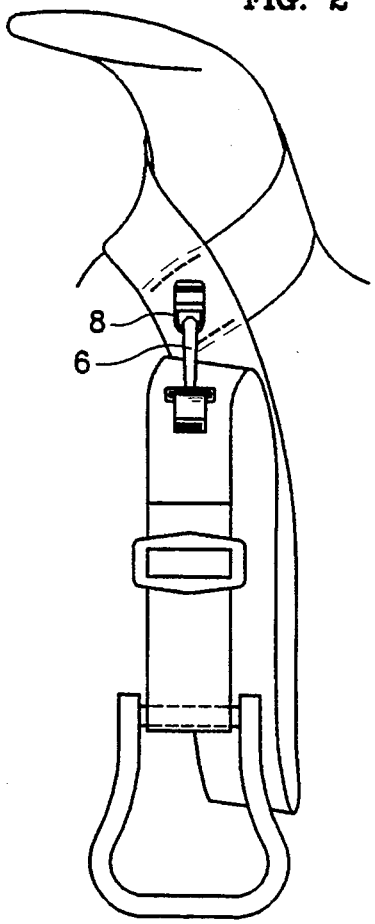
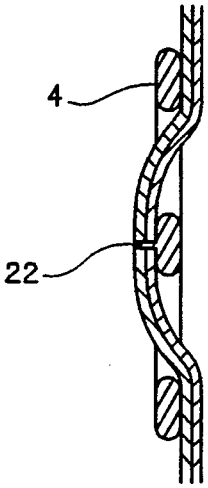
FIG. 5
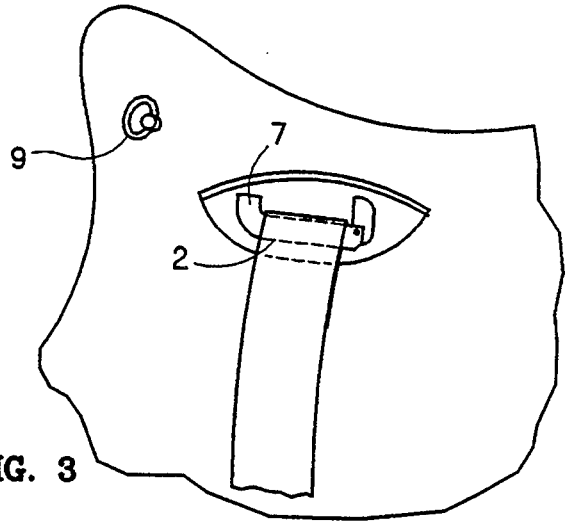
FIG. 3

MOUNTING STIRRUP

BACKGROUND OF THE INVENTION

This invention relates to the problem that short people or young people have in reaching the stirrups on conventional Western and English Saddles when attempting to mount a large horse. Prior to this invention, the youthful or short rider was dependent upon another person to assist or boost the rider, to allow the rider to reach and insert their foot into the stirrup of the saddle. If another person was not available, the rider generally sought a rock, box, stool, fence or other inanimate object to assist them in reaching the stirrup. This practice, though common, is unsafe and less practical, as the horse sensing the reason for being positioned near the inanimate object often pulls away foiling the attempt to mount. This procedure is also limited by the availability of said inanimate object.

SUMMARY OF THE INVENTION

The invention is a low-cost device that allows the young or short equestrian to safely, conveniently and without other assistance, reach the stirrup of a saddle and thereby allowing the equestrian to gain access to the saddle.

This invention includes a 4 to 5 foot long strap, approximately 1½" to 2" wide made of polypropylene, nylon, leather or other strong flexible material. The strap has a youth size stirrup attached at one end by means of a buckle or other adjusting device and a loop on the other end of such size as to allow it to pass over the horn of a Western Saddle. This loop can also be hooked over the stirrup bar of an English Saddle. The strap has a small "D" ring positioned toward the loop end and a snap of either plastic or metal materials, positioned toward the stirrup end that allow the invention to be stored on the saddle during the riding phase.

To mount the horse, the rider stands on the left side of the horse and inserts her right foot in the mounting stirrup of the present invention. The rider then steps up and inserts her left foot in the saddle's regular stirrup. The rider then steps up again and puts her right leg over the horse and mounts the saddle. The mounting stirrup is then stowed by attaching the snap to the "D" ring. When a rider desires to dismount the reverse procedure is followed.

Objects of the invention are to provide a safe and effective manner in which a short or youthful equestrian can safely mount a horse without assistance from other equestrians or inanimate objects.

It is another object of the invention to provide a secure and efficient means of attaching the device to a Western or English Saddle and storing the device while the horse is being ridden. Other objects and advantages of the invention will become apparent as the following detailed description is read with reference to the accompanying drawings.

BRIEF DESCRIPTION OF THE DRAWINGS

FIG. 1 illustrates the preferred embodiment of the invention when connected to the horn of a Western Saddle;

FIG. 2 illustrates the preferred embodiment of the invention when in the stored position;

FIG. 3 illustrates the invention when connected to an English Saddle;

FIGS. 4 and 5 illustrate the type of buckle used when the strap is made of leather;

DETAILED DESCRIPTION OF THE INVENTION

Figure 6:
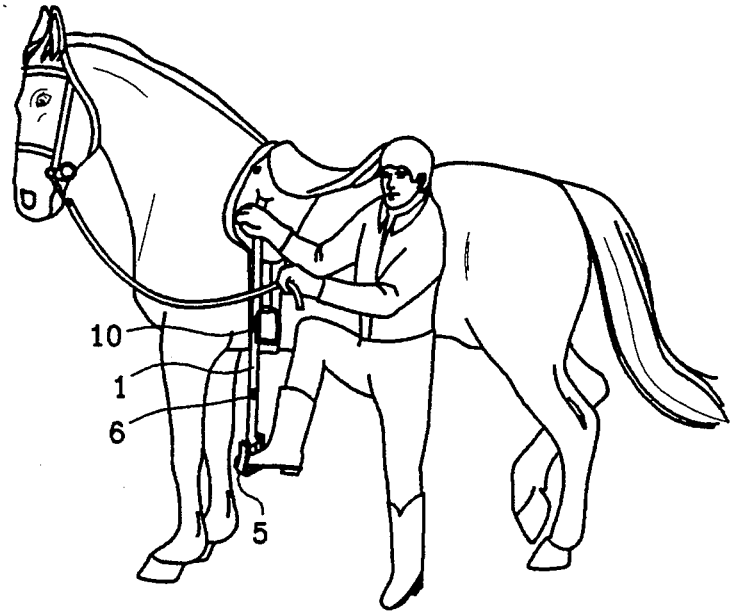
FIGS. 6 and 7 illustrate use of the invention during the mounting phase.

In FIG. 1, the strap 1 is illustrated with the preferred embodiment of the invention showing a loop 2 secured over the horn 3 of a Western Saddle. The preferred embodiment of the invention has the strap 1 hanging aft of the horn 3, however, strap 1 may be used hanging fore of the horn. Stirrup 5 is attached to the strap by an adjusting device 4 as shown in FIGS. 1, 4 and 5.

FIG. 2 illustrates the preferred embodiment of the invention in the stored position on a Western Saddle utilizing the "D" ring 8 and snap 6. After the rider has mounted the horse the rider pulls up the lower portion of the mounting strap 1 and attaches the snap 6 to the "D" ring 8. FIG. 1 also shows the snap 6 and the "D" ring 8. The mounting stirrup remains in this stored position while the horse is being ridden.

When the rider decides to dismount the horse, the snap 6 is disengaged from the "D" ring 8 and the stirrup 5 is lowered to a position so that the rider can use the mounting stirrup as a last step before touching the ground while dismounting the horse.

FIG. 3 illustrates the preferred embodiment of the invention when used on an English Saddle. Loop 2 is secured over the stirrup bar 7. When used in the stored position on an English Saddle, the snap 6 can be hooked over a "D" ring 9 found on substantially all English saddles. When the loop 2 is passed over the stirrup bar 7, the stirrup bar already has straps from the saddle's regular stirrups attached to it. Therefore, the loop 2 has to be sufficiently large to allow the loop 2 to fit over the stirrup bar when the regular stirrup straps are already attached.

FIG. 4 shows a standard buckle arrangement that would be used when the straps are made of leather as opposed to nylon or polypropylene webbing. FIG. 4 shows that the strap has holes 20 in the center part of the strap which are used to engage a post 22 shown in FIG. 5. This prevents the leather straps from slipping when a person is using the mounting stirrup to mount a horse. These holes 20 and post 22 are unnecessary as shown in FIG. 1 when the strap 1 is made of nylon or polypropylene webbing because there is sufficient friction to prevent the strap from slipping in the buckle when the mounting stirrup is being used.

Figure 7:
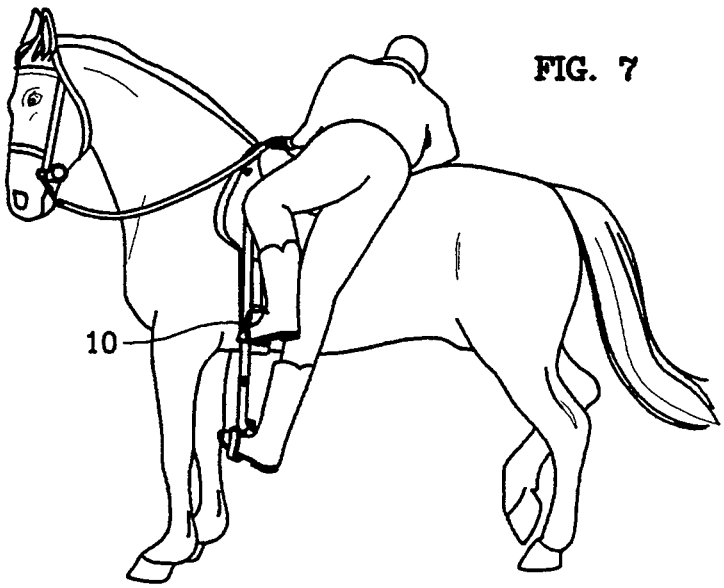
Figure 8:
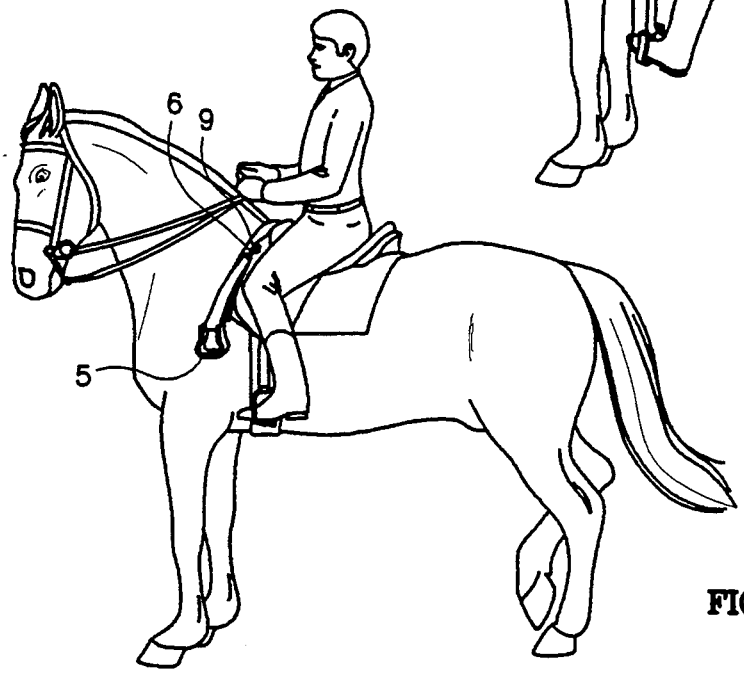
FIG. 8 illustrates the invention in the stored position.

FIGS. 6 and 7 illustrate the mounting procedure using the invention in its preferred embodiment. The procedure for mounting both English and Western Saddles is the same with the exception that the equestrian can use the horn 3 (FIG. 1) to pull himself or herself up with the Western Saddle. With the English Saddle the equestrial uses the front edge of the saddle to grasp and pull himself or herself up. The invention provides the equestrian with a step-up by allowing the equestrian to insert his or her right foot into the mounting stirrup 5, which is lower than the saddle's regular stirrups as shown in FIG. 6. The mounting stirrup can be of either the open style as shown or the hooded version as used on standard children's sized saddles. By stepping and pulling himself or herself up, the person can insert his or her left foot into the left stirrup of the English or Western Saddle, as shown in FIG. 7. The equestrian then swings his or her right leg over the saddle and seats himself or herself as illustrated in FIG. 8. FIG. 8 illustrates the preferred embodiment of the invention in the stored position on an English saddle. To put the mounting stirrup in the stored position, the rider simply pulls up on the strap 1 until the snap 6 can be attached to the "D" ring 9 which is normally a part of any English riding saddle.

The strap material should have the following characteristics: flexibility, strength (sufficient to support a minimum of 300 pounds), sufficient length to allow for adjustment for various sized equestrians, and can be bar-tacked or riveted to form a loop that will support a minimum of 300 pounds downward load.

The "D" ring 8 and snap 6 are used merely to store the invention during the riding phase. Load limits of the "D" ring 8 and snap 6 are much less because they are not used to support the rider.

The stirrup 5 can be of any material, color or size as long as it is of sufficient strength to support a minimum 300 pounds of downward load exerted by the equestrian's foot. The stirrup 5 can be either a standard open variety or a hooded variety used on children's saddles.

The buckle 4 or adjusting device can be constructed of plastic, metal or other materials sufficiently strong so as not to fail when a minimum of 300 pounds of downward load is applied to the stirrup.

The FIGS. 1 through 8 and the description are the preferred embodiment of the invention and are not meant to limit the use, as the invention may be used on any saddle having a horn, stirrup bar or any other device by which the invention may be attached to the saddle thereby providing the equestrian with a safe convenient method of mounting said saddle.

Various changes and modifications will occur to those skilled in the art. The invention has been presented with regard to specific details and it should be noted that many details may be altered without departing from the scope of the invention as defined in the following claims.

We claim:

1. A mounting stirrup assembly comprising:

strap means of at least four feet in length when fully extended having two ends, said strap means having an attachment means at one end that cannot function as a normal riding stirrup adapted for attachment to a saddle already having riding stirrups, said strap means having a mounting stirrup attached to the other end of said strap means, said strap means having no more than a single stirrup attached thereto, and said strap means is made so that when said strap means is attached to said saddle, said mounting stirrup always hangs below the riding stirrups of said saddle when said mounting stirrup is being used to mount a horse.

2. A mounting stirrup assembly as in claim 1 including means for adjusting the length of said strap means.

3. A mounting stirrup assembly of claim 2 including ring means attached to an upper portion of said strap means and snap means attached to a lower portion of said strap means wherein said snap means is adapted to be attached to said ring means.

4. A mounting stirrup assembly as in claim 1 including means for securing a lower portion of said strap means to an upper portion of said strap means.

* * * * *